United States Patent [19]

Nelson et al.

[11] Patent Number: 5,009,772

[45] Date of Patent: Apr. 23, 1991

[54] SOLVENT EXTRACTION PROCESS

[75] Inventors: Stephen R. Nelson; Richard L. Hood, both of Edmond, Okla.

[73] Assignee: Kerr-McGee Corporation, Oklahoma City, Okla.

[21] Appl. No.: 315,489

[22] Filed: Feb. 27, 1989

[51] Int. Cl.[5] ..... C10C 3/08

[52] U.S. Cl. ..... 208/309; 208/177; 208/317; 208/313; 208/319; 208/322; 208/337; 208/435; 208/428; 208/829

[58] Field of Search ..... 208/452, 435, 304, 313, 208/319, 322, 177, 317, 337

[56] References Cited

U.S. PATENT DOCUMENTS

| | | | |
|---|---|---|---|
| 2,130,147 | 9/1938 | Milmore | 208/319 |
| 2,202,389 | 5/1940 | Lewis | 208/319 |
| 2,246,227 | 6/1941 | Webb | 208/319 |
| 2,281,865 | 5/1942 | Van Dijck | 208/319 |
| 2,284,583 | 5/1942 | Lewis | 208/319 |
| 2,606,859 | 8/1952 | Benedict | 208/319 |
| 2,941,941 | 6/1960 | Groll | 208/319 |
| 3,445,537 | 5/1969 | Luther et al. | 208/319 |
| 4,528,100 | 7/1985 | Zarchy | 208/309 |
| 4,547,292 | 10/1985 | Zarchy | 208/309 |
| 4,548,711 | 10/1985 | Coombs et al. | 208/309 |
| 4,675,101 | 6/1987 | Warzinski | 208/309 |
| 4,784,753 | 11/1988 | Hotier et al. | 208/309 |

FOREIGN PATENT DOCUMENTS

| | | | |
|---|---|---|---|
| 0600058 | 6/1960 | Canada | 208/319 |
| 0449717 | 2/1936 | United Kingdom | 208/319 |

OTHER PUBLICATIONS

*Handbook of Petroleum Refining Processes,* Part 8.1, pp. 19-51, by R. A. Meyers, McGraw-Hill Book Co., N.Y., N.Y. (1986).

*Primary Examiner*—Patrick P. Garvin
*Assistant Examiner*—E. D. Irzinski
*Attorney, Agent, or Firm*—Herbert M. Hanegan; John P. Ward

[57] ABSTRACT

A solvent extraction process for separating a heavy hydrocarbon feedstock material into its various component parts. The process comprises the utilization of pressure reduction to enhance the separation and recovery of a deasphalted oil product comprising substantially the lower molecular weight hydrocarbon components present in the original heavy hydrocarbon feedstock material.

8 Claims, 2 Drawing Sheets

SOLVENT EXTRACTION PROCESS

FIELD OF THE INVENTION

The present invention relates to a solvent extraction process for separating heavy hydrocarbon materials into their component parts. More particularly, the present invention relates to a continuous solvent deasphalting process wherein controlled reductions in operating pressures are utilized to enhance the selectivity of the extraction solvent employed.

BACKGROUND OF THE INVENTION

The use of solvent extraction to separate heavy hydrocarbon materials such as, for example, steam and vacuum reduced crudes into two or more of their component parts is well known. In this regard, many different solvent extraction processes have been proposed or are in use for performing the separation. One widely employed solvent extraction process, utilizing a vertically positioned extraction vessel, is the relatively low temperature, countercurrent flow, solvent deasphalting process described in R. A. Meyers' *Handbook of Petroleum Refining Processes,* Part 8.1, pp 19–51, McGraw-Hill Book Co., N.Y., N.Y. (1986). Typically, this process entails diluting a heavy hydrocarbon material or feedstock with a quantity of an extraction solvent, adjusting the diluted feedstock to the desired extraction temperature and introducing the diluted feedstock into a medial section of the extraction vessel. Contemporaneously with the introduction of the diluted feedstock, further extraction solvent is introduced into a bottom section of the extraction vessel whereby the feedstock and extraction solvent undergo intimate contact while flowing in countercurrent directions. This contact results in the lower molecular weight components contained in the feedstock being extracted therefrom and in the formation of separate and distinct extract and raffinate phases. The extract phase thus formed contains the lower molecular weight hydrocarbon components of the feedstock (which components comprise a so-called deasphalted oil) and the major portion of the solvent while the raffinate phase contains the remaining higher molecular weight hydrocarbon components of the feedstock, (including the high molecular weight asphaltenes and intermediate molecular weight resins) as well as the Conradson carbon precursors and the bulk of the heavy metals contained therein and a residual portion of the solvent. Following the recovery of these phases, each then is subjected to further processing to strip and individually recover the solvent portions, the deasphalted oil and the higher molecular hydrocarbon components (the latter containing both the Conradson precursors and heavy metals).

In the practice of the above generally described solvent deasphalting process, it is conventional practice to control the quantity and quality of the deasphalted oil extracted from the feedstock either by increasing or decreasing the density of the extraction solvent. On a day-to-day operating basis, this change in density usually is accomplished by varying the temperature of the feedstock and solvent being introduced into the extraction vessel although changes in operating pressure also can be employed.

It also is possible to provide for significant improvements in the quality of the deasphalted oil product for any given desired yield of deasphalted oil product by further maintaining a temperature gradient across the extraction zone. This practice typically involves maintaining a higher temperature in the top or rectification section of the extraction vessel, by means of steam coils fitted therein, and a lower temperature in the bottom or stripping section of the extraction vessel. This temperature gradient generates an internal reflux due to the lower solubility of the heavier hydrocarbon components of the feedstock in the solvent at the higher temperatures in the top section of the extraction vessel compared to their higher solubility in the solvent at the lower temperatures in the bottom section of the extraction vessel. While the use of temperature induced internal reflux within an extraction vessel does, in fact, improve the quality of the deasphalted oil products, such use results in a significant increase in utilities consumption, particularly steam. Thus, the development of means for maintaining or even improving the quality of the deasphalted oil products produced by such processes without adversely affecting the utilities consumption of such processes would be a significant contribution to this field.

SUMMARY OF THE INVENTION

In accordance with the present invention, a process for the separation and recovery of high quality deasphalted oil products from heavy hydrocarbon materials is provided. More particularly, the present invention relates to a continuous, relatively low temperature deasphalting process in which a heavy hydrocarbon feedstock material and an extraction solvent are contacted, preferably in a countercurrent flow relationship, at elevated subcritical temperatures and superatmospheric pressures, in an extraction zone to produce a first light extract phase rich in lower molecular weight hydrocarbon components and a first heavy raffinate phase rich in higher molecular weight hydrocarbon components, Conradson carbon precursors and heavy metals.

Specifically, the present invention comprises continuously effecting a reduction in the pressure upon the first light extract phase produced within the extraction zone. This pressure reduction results in a decrease in the density of the extraction solvent contained in this first light extract phase, the rejection of any residual higher molecular weight hydrocarbon components, Conradson carbon precursors and heavy metals dissolved or entrained therein and the production of a second light extract phase enriched in the lower molecular weight hydrocarbon components and a second heavy raffinate phase enriched in the higher molecular weight hydrocarbon components, Conradson carbon precursors and heavy metals. The improvement of the present invention further comprises recovering the second heavy raffinate phase, repressurizing it to the pressures prevailing within the extraction zone and reintroducing it into the extraction zone to provide a source of external reflux for the heavy hydrocarbon feedstock material and extraction solvent being contacted therein.

DETAILED DESCRIPTION OF THE INVENTION

The present invention relates to improvements in the continuous solvent deasphalting of heavy hydrocarbon materials and which materials include pyrogenous bitumens, native bitumens and one or more fractions or components thereof. Representative, but nonlimiting, examples of the pyrogenous bitumens include heavy or very low API gravity petroleum crudes, reduced crudes (both steam and vacuum distilled), hard and soft wood pitches, coal tar residues, cracked tars, tall oil and the like. Representative, but nonlimiting, examples of native bitumens include gilsonite, wurzilite, albertite and the like and native asphalts such as, for example, Trinidad asphalt and the like. By the term "one or more fractions or components thereof" is meant a pyrogenous or native bitumen from which a portion or the total asphaltene content has been removed or from which the total asphaltene content as well as a portion of the resin content have been removed.

The improvements of the present invention are broadly applicable to any of the various continuous solvent deasphalting processes practiced in this field and in which processes a wide range of extraction apparatus including, for example, mixer-settlers, "extractor" or "contactor" towers and the like have been and are employed. The present invention particularly is applicable to those extraction processes utilizing the aforementioned extraction towers and in which towers the heavy hydrocarbon material and extraction solvent are added to the towers individually and contacted therein in a countercurrent flow relationship. Due to the fact that the use of countercurrent contact between the heavy hydrocarbon material and extraction solvent provides for a much more effective means for separating a heavy hydrocarbon material, this means has been selected for purposes of simplifying the explanation and description of the present invention.

Figure 1:
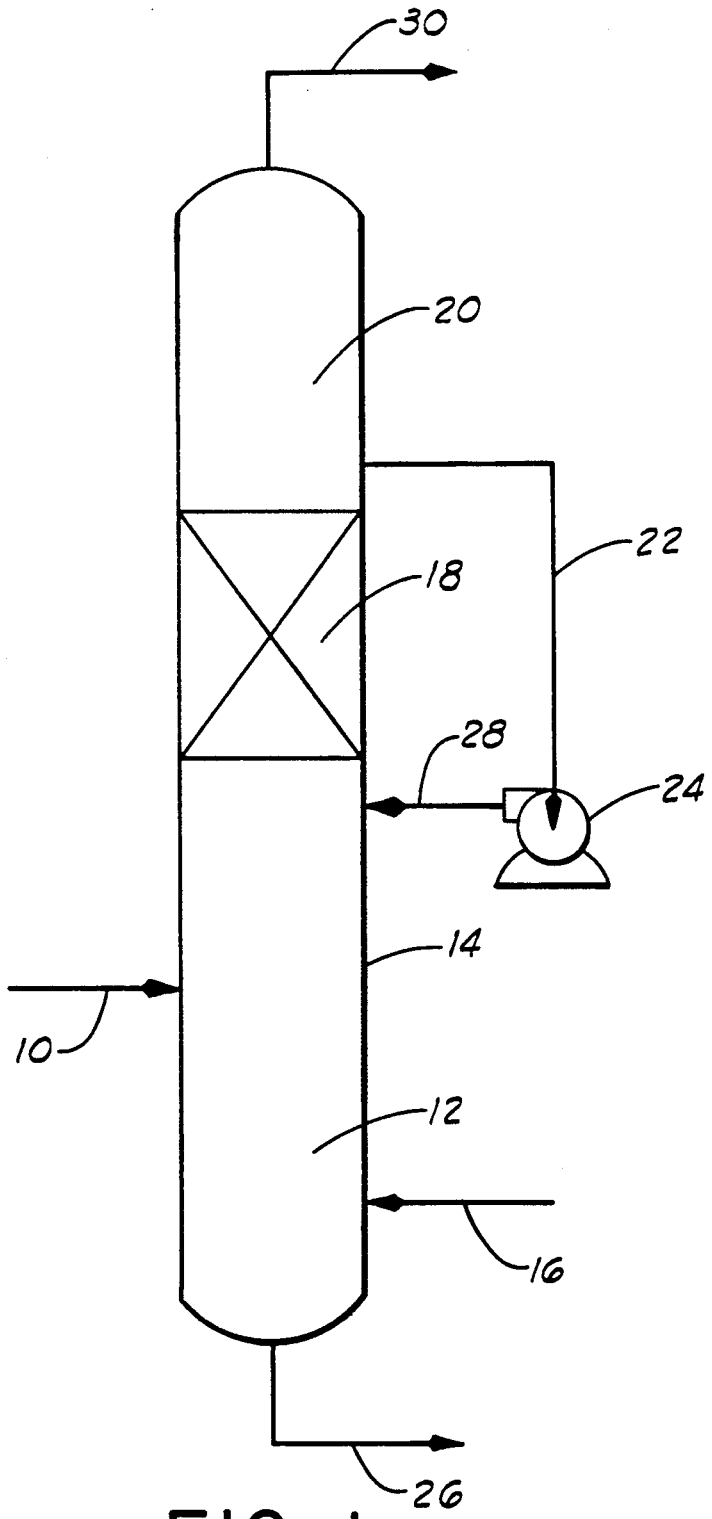
FIG. 1 is a diagrammatical illustration of one embodiment of the invention wherein the pressure reduction is performed within the extraction zone.

With reference to FIG. 1, a liquid feedstock, comprising a heavy hydrocarbon material such as, for example, a reduced crude, is introduced via a conduit 10 into a medial section of a high pressure compartment 12 of an extraction zone 14. Prior to the introduction of the liquid feedstock into the high pressure compartment 12, the liquid feedstock may be prediluted, depending upon its original viscosity and flow characteristics, in a mixing zone (not shown) with a portion of the total hydrocarbon solvent utilized in effecting the extraction of the liquid feedstock. Broadly, the amount of the hydrocarbon solvent which can be mixed with the liquid feedstock can range from 0 to about 70 volume percent of the total hydrocarbon solvent employed in the extraction stage with an amount in the range of from about 10 to about 25 volume percent being preferred. However, in those solvent deasphalting processes wherein countercurrent extraction is not employed, such as those processes utilizing, for example, mixer-settler type extraction apparatus, the amount of the hydrocarbon solvent mixed with the liquid feedstock then will be the total amount of the solvent required to effect the desired extraction.

Contemporaneously with the introduction of the liquid feedstock or prediluted liquid feedstock into the high pressure compartment 12, the hydrocarbon solvent which will comprise a light organic material selected from the group consisting of paraffinic hydrocarbons containing from about 3 to about 6 carbon atoms is introduced into a lower section of the high pressure compartment 12. This introduction is achieved via a solvent conduit 16. The amount of the hydrocarbon solvent introduced via the solvent conduit 16 will be an amount which upon contact with the liquid feedstock or prediluted liquid feedstock in the high pressure compartment 12 will provide an extraction mixture containing a solvent to liquid feedstock volume ratio ranging from about 4:1 to about 20:1.

Within the high pressure compartment 12 of the extraction zone 14 the heavier liquid feedstock, comprising a dispersed phase within the extraction mixture, flows in a downward direction and the lighter hydrocarbon solvent, comprising a continuous phase within the extraction mixture, flows in an upward direction. This countercurrent flow maximizes the extraction of the descending droplets of the liquid feedstock by the rising hydrocarbon solvent thus providing for greater dissolution of the lower molecular weight hydrocarbons components (i.e., the oil components) contained in the liquid feedstock.

In addition to the use of countercurrent flow techniques to maximize the extraction of the liquid feedstock and thus the separation of the desired lower molecular weight hydrocarbon components therefrom, elevated subcritical temperatures and superatmospheric pressures also are maintained within the extraction zone 14 to enhance this separation. In the operation of a low temperature solvent deasphalting process, the temperatures maintained within the extraction zone 14 generally will range from about 45° C. to about 252° C. but always below the critical temperature of the particular hydrocarbon solvent being employed. For example, when utilizing propane as the extraction solvent the operating temperatures most usually employed will range from about 45° C. to about 82° C. while the critical temperature of propane is about 97° C. Typically, the temperatures which will be utilized and maintained within the extraction zone 14 will range from about 5° C. to about 20° C. or more below the critical temperature of the particular hydrocarbon solvent employed.

As noted hereinabove, the extraction zone 14 also will be maintained at superatmospheric pressures. In general, the pressures maintained within extraction zone 14 will range from above about the equilibrium vapor pressure of the particular hydrocarbon solvent being utilized at the elevated subcritical temperature employed up to or above about the critical pressure of the hydrocarbon solvent.

Under the above conditions, the liquid feedstock introduced into the high pressure compartment 12 undergoes fractionation into a first light extract phase comprising the lower molecular weight hydrocarbon components (i.e., the light oil components) and a major portion of the hydrocarbon solvent and a first heavy raffinate phase comprising the remainder of the liquid feedstock, i.e., the higher molecular weight hydrocarbon components, Conradson carbon precursors and heavy metals, and a residual portion of the hydrocarbon solvent. The first light extract phase is collected in an upper or rectification section of the high pressure compartment 12 while the first heavy raffinate phase is collected in a lower or stripping section thereof. This first heavy raffinate phase is withdrawn from the high pressure compartment 12 of the extraction zone 14 by way of a raffinate conduit 26. Once the first heavy raffinate phase is withdrawn from the extraction zone 14 it is stripped of its residual hydrocarbon solvent content in a solvent recovery zone (not shown) such as a stripper.

The first light extract phase, which continuously collects in the upper section of the high pressure compartment 12, is withdrawn therefrom and conveyed through a pressure reduction compartment 18 located immediately adjacent to and above the upper section of the high pressure compartment 12 and immediately adjacent to and below a lower section of a low pressure compartment 20. For the purpose of the present invention, the pressure reduction compartment 18 can comprise an area equipped with either a series of horizontally positioned, spaced apart trays or plates such as sieve, bubble-cap or valve-type trays or an area filled with any of a number of different packing materials such as rasching, lessing or pall rings or berl or intalox saddles and the like. Whether equipped with trays or filled with packing materials such devices effectively function to provide a reduction or drop in pressure upon the first light extract phase as this phase is conveyed through the pressure reduction compartment 18.

As the first light extract phase is conveyed through pressure reduction compartment 18, the pressure upon this phase is reduced. The purpose of this pressure reduction is to effect a decrease in the density of the hydrocarbon solvent contained in the first extract phase. In this regard, the extent of the pressure reduction or pressure drop within pressure reduction compartment 18 will be an amount sufficient to achieve the desired decrease in solvent density but insufficient to induce boiling of the hydrocarbon solvent employed at the particular extraction temperature being maintained in the extraction zone 14. Broadly, reductions in the pressure upon the first light extract phase ranging up to about 400 psi or higher, and preferably in the range of from about 200 to about 350 psi will be sufficient to provide the decreases in solvent density desired but insufficient to induce boiling of the hydrocarbon solvent.

As noted above, as the first light extract phase is conveyed from the upper or rectification section of the high pressure compartment 12, through the pressure reduction compartment 18 and into the lower section of the low pressure compartment 20, the hydrocarbon solvent therein undergoes a decrease in density. As a result of this decrease in density, the affinity of the hydrocarbon solvent for any residual higher molecular weight hydrocarbon components, Conradson carbon precursors and heavy metals either dissolved or entrained in this first light extract phase also decreases. This results in the rejection of these residual materials from this phase. Thus, within low pressure compartment 20, this phase undergoes further phase separation into a second light extract phase which rises and collects in an upper section of the low pressure compartment 20 and a second heavy raffinate phase which settles and collects in the lower section of the low pressure compartment 20. This pressure induced reduction in solvent density thus functions in a manner analogous to the use of steam coils in conventional solvent deasphalting processes to effect rectification or enrichment of the light extract phases produced therein.

The second light extract phase, containing hydrocarbon solvent enriched in the lower molecular weight hydrocarbon components, i.e., the light oil components, is withdrawn from the extraction zone 14 and specifically from the upper section of the low pressure compartment 20 therein via an extract conduit 30. Once this second light extract phase is withdrawn from the extraction zone 14, it is conveyed via the extract conduit 30 to a solvent recovery zone (not shown) wherein it is stripped of the hydrocarbon solvent contained therein. In this respect, stripping of the second light extract phase easily can be performed utilizing any of the well-known multiple effect and supercritical solvent recovery processes such as those described in R. A. Meyers, ibid., pp 30–34.

The second heavy raffinate phase comprising the rejected higher molecular weight hydrocarbon components, Conradson carbon precursors and heavy metals which settle and collect in the lower section of the low pressure compartment 20 is withdrawn therefrom via a raffinate conduit 22. This withdrawn second heavy raffinate phase then is recycled back, either with or without additional heating of this phase, to the upper section of the high pressure compartment 12 of the extraction zone 14 by way of the raffinate conduit 22, a pump 24 (wherein this raffinate phase is repressurized to the operating pressure being maintained within the high pressure compartment 12 of the extraction zone 14) and a conduit 28. Thus, this withdrawn second heavy raffinate phase constitutes a source of external reflux for the extraction process, and once returned to the high pressure compartment 12 of the extraction zone 14, functions to further enhance the separation of the liquid feedstock within the high pressure compartment 12 of the extraction zone 14.

Figure 2:
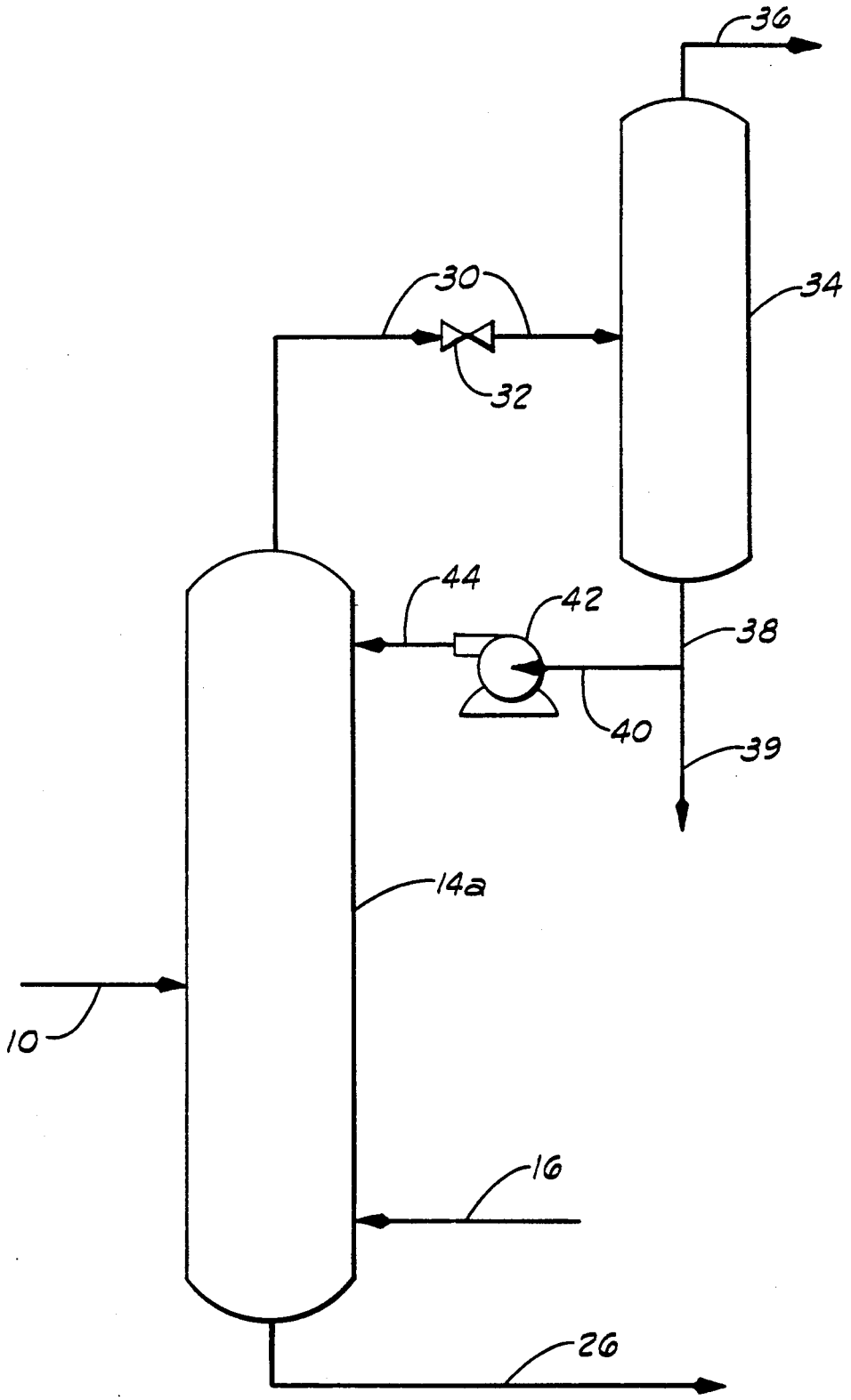
FIG. 2 is a diagrammatical illustration of another embodiment of the invention wherein the pressure reduction is performed outside the extraction zone.

For another embodiment of the present invention, reference is made to FIG. 2. In accordance with the embodiment illustrated in FIG. 2, the liquid feedstock is introduced via conduit 10 into a medial section of an extraction zone **14*a*** which can comprise, for example, a vertically positioned "contactor" or "extractor" tower including towers of the rotating disc-type. Again, and in a manner such as described above, the liquid feedstock can be prediluted in a mixing zone (not shown) with a portion of the total hydrocarbon solvent utilized to effect the extraction of the liquid feedstock.

Contemporaneously with the addition of the liquid feedstock or prediluted feedstock into the extraction zone **14*a*, a hydrocarbon solvent of the type described hereinabove is introduced into a lower section of the extraction zone 14*a* via the solvent conduit 16. Within the extraction zone 14*a*, the extraction mixture of the liquid feedstock and the hydrocarbon solvent will be maintained at the elevated subcritical temperatures and superatmospheric pressures described above. As the extraction of the liquid feedstock proceeds, the first light extract phase produced thereby and comprising the lower molecular weight hydrocarbon components (i.e., the light oil components) and a major portion of the hydrocarbon solvent continuously collects in an upper or rectification section of the extraction zone 14*a*. At the same time, the first heavy raffinate phase comprising the remainder of the liquid feedstock components i.e., the higher molecular weight hydrocarbon components (including the asphaltenes and resins), the Conradson carbon precursors and the heavy metals and the residual portion of the hydrocarbon solvent continuously collects in a lower section of the extraction zone 14*a*. This first heavy raffinate phase is withdrawn from the lower section of the extraction zone 14*a* via the raffinate conduit 26** and is stripped of its residual portion of hydrocarbon solvent in a solvent recovery zone (not shown) such as a stripper.

The first light extract phase, which continuously is collected in the upper or rectification section of the extraction zone 14a is withdrawn therefrom via the extract conduit 30. Within the extract conduit 30 the pressure upon this phase is reduced utilizing a pressure reduction means 32 which can be, for example, a conventional throttle valve. The first light extract phase, now at a pressure lower than the pressure in the extraction zone 14a, then is introduced via the extract conduit 30 into a low pressure phase separation zone 34. Within this low pressure phase separation zone 34 the first light extract phase undergoes further separation into two additional phases. These two additional phases include a second light extract phase comprising hydrocarbon solvent enriched in lower molecular weight hydrocarbon components (i.e., the light oil components) which phase rises and collects in an upper section of the phase separation zone 34, and a second heavy raffinate phase comprising rejected residual higher weight hydrocarbon components, Conradson carbon precursors and heavy metals dissolved or entrained in the first light extract phase and which second heavy raffinate phase settles and collects in a lower section of the phase separation zone 34. As disclosed above, this separation occurs due to the decrease in the density of the hydrocarbon solvent contained in the first light extract phase effected through the reduction in pressure upon the first extract phase.

The second light extract phase, containing a major portion of the hydrocarbon solvent enriched in the light oil components, is withdrawn from the upper section of the phase separation zone 34 via extract conduit 36. Once the second light extract phase is withdrawn from the phase separation zone 34 it is stripped of its hydrocarbon solvent content in a solvent recovery zone (not shown) and the hydrocarbon solvent and the light oil components (comprising a deasphalted oil product) individually recovered. Such solvent recovery zone can include, as noted hereinabove, any of the multiple-effect and supercritical solvent recovery processes known and utilized in the petroleum refining industry.

With regard to the second heavy raffinate phase collected in the lower section of the low pressure phase separation zone 34, this phase is withdrawn therefrom via a raffinate conduit 38. This withdrawn raffinate phase, like the second raffinate phase described with respect to the embodiment illustrated by FIG. 1. also constitutes a source of external reflux which can be utilized for enhancing the selectivity of the extraction process. Thus, in this embodiment of the present invention, at least a portion of the second heavy raffinate phase withdrawn from the low pressure phase separation zone 34 via raffinate conduit 38 is recycled back to extraction zone 14a. In this regard, a portion or all of the second heavy raffinate phase flowing through raffinate conduit 38 is withdrawn therefrom and conveyed, either with or without heating of this phase by means not shown, via a conduit 40, a pump 42 and conduit 44 to extraction zone 14a. The pump 42 functions to increase the pressure upon the second raffinate phase phase to the operating pressure being maintained within the extraction zone 14a. Any remaining portion of this second heavy raffinate phase not utilized as external reflux in the extraction zone 14a can be combined with the first heavy raffinate phase being conveyed through the raffinate conduit 26 or recovered as a separate product of the extraction process.

While the present invention has been described with respect to the treatment of a heavy hydrocarbon feedstock material such as, for example, a steam or vacuum reduced crude, it also is applicable to the treatment of lighter feedstocks containing "one or more fractions or components thereof" which, as defined hereinabove, includes pyrogenous and native bitumens from which a portion or all of the asphaltene content has been removed or from which all of the asphaltene content as well as a portion of the resin content have been removed. Such feedstock materials thus would contain only a portion or none of the asphaltene components (i.e., the higher molecular weight hydrocarbon components), most or all of the resin components (i.e., the intermediate molecular weight hydrocarbon components) and all of the light oil components (i.e., the lower molecular weight hydrocarbon components). When utilizing feedstock materials of this nature, the extract phases produced by the present invention will be comprised of the light oils and the majority of the hydrocarbon solvent and the raffinate phases a portion or none of the asphaltenes, all of the resins and any residual hydrocarbon solvent.

From the foregoing description it will be appreciated that by using pressure reduction for the purpose of effecting changes in the density of the extraction solvent, the present invention offers a more economical and advantageous solvent deasphalting process for the separation of heavy hydrocarbon feedstocks compared to solvent deasphalting processes utilizing temperature increases for this purpose.

Changes may be made in the operation and arrangement of the various parts, elements, steps and procedures described herein without departing from the spirit and scope of the invention as defined in the following claims.

We claim:

1. A continuous solvent deasphalating process for separating a heavy hydrocarbon material feedstock containing both solvent soluble lower molecular weight hydrocarbon components and solvent insoluble higher molecular weight hydrocarbon components, Conradson carbon precursors and heavy metals comprising:

contacting said feedstock with an extraction solvent in an extraction zone, said zone containing a high pressure compartment, a pressure reduction compartment and a low pressure compartment and whereby said contact is initially effected in said high pressure compartment, to continuously form an extraction mixture comprised of said feedstock as a dispersed phase and said extraction solvent as a continuous phase, said contact being carried out in said high pressure compartment of said extraction zone in a countercurrent flow relationship at an elevated temperature ranging from about 5° C. to about 20° C. or more below said extraction solvent's critical temperature and under a superatmospheric pressure of about about the equilibrium vapor pressure of said extraction solvent at the elevated temperature employed;

maintaining said extraction mixture in said high pressure compartment of said extraction zone at said elevated temperature and under said superatmospheric pressure, whereby a first light extract phase rich in said solvent soluble lower molecular weight hydrocarbon components and a first heavy raffinate phase rich in said solvent insoluble higher molecular weight hydrocarbon components, Conradson carbon precursors and heavy metals form and separate individually from said extraction mixture within said high pressure compartment of said extraction zone;

maintaining said extraction mixture and said first heavy raffinate phase in such high pressure compartment of said extraction zone at said elevated temperature and under said superatmospheric pressures while withdrawing said first light extract phase from said high pressure compartment and introducing said first light extract phase into said pressure reduction compartment of said extraction zone;

reducing the pressure upon said first light extract phase within said pressure reduction compartment of said extraction zone, while maintaining said extract phase at said elevated temperature, by an amount sufficient to effect within said low pressure compartment of said extraction zone a separation of said first light extract phase into a second light extract phase enriched in said solvent soluble lower molecular weight hydrocarbon components and a second heavy raffinate phase rich in said solvent insoluble higher molecular weight hydrocarbon components, Conradson carbon precursors and heavy metals;

withdrawing said reduced pressure first light extract phase from said pressure reduction compartment of said extraction one and introducing said reduced pressure first light extract phase into said lower pressure compartment of said extraction zone wherein said separation is effected and recovering individually from said lower pressure compartment of said extraction zone said second light extract phase and said second heavy raffinate phase; and repressurizing at least a portion of said second heavy raffinate phase recovered from said low pressures compartment of said extraction zone to said superatmospheric pressure being maintained upon said extraction mixture and said first light extract phase and said first heavy raffinate phase being formed within said high pressure compartment of said extraction zone and recycling said repressurized portion back to said high pressure compartment of said extraction zone to provide reflux for said first light extract phase and said extraction mixture contained therein.

2. The process of claim 1 wherein said extraction solvent comprises a light organic material selected from the group consisting of paraffinic hydrocarbons containing from about 3 to about 6 carbon atoms.

3. The process of claim 1 wherein said feedstock and said extraction solvent are contacted in amounts sufficient to provide in said extraction mixture a solvent to feedstock volume ratio ranging from about 4:1 to about 20:1.

4. The process of claim 1 wherein said extraction mixture is maintained under a superatmospheric pressure ranging from above about the equilibrium vapor pressure of said extraction solvent contained in said extraction mixture at said elevated subcritical temperature employed up to and above the critical pressure of said extraction solvent.

5. The process of claim 1 wherein said superatmospheric pressure upon said first light extract phase is reduced an amount sufficient to effect a decrease in density of said extraction solvent contained in said extract phase and insufficient to induce boiling of said extraction solvent.

6. The process of claim 5 wherein said superatmospheric pressure upon said first light extract phase is reduced an amount ranging up to about 400 psia.

7. The process of claim 6 wherein said superatmospheric pressure upon said first light extract phase is reduced an amount ranging from about 200 to about 350 psia.

8. The process of claim 1 wherein said reduction in the superatmospheric pressure upon said first light extract phase is performed external to said extraction zone.

* * * * *